US010076463B2

(12) United States Patent
Fine et al.

(10) Patent No.: US 10,076,463 B2
(45) Date of Patent: Sep. 18, 2018

(54) VIBRATING ELECTROMECHANICAL DEVICE FOR FEMALE STIMULATION

(71) Applicant: Mating Components, LLC, New York, NY (US)

(72) Inventors: Alexandra Fine, Brooklyn, NY (US); Janet S. Lieberman, Brooklyn, NY (US); Ariel Douglas, Brooklyn, NY (US)

(73) Assignee: Mating Components, LLC, Brooklyn, NY (US)

( * ) Notice: Subject to any disclaimer, the term of this patent is extended or adjusted under 35 U.S.C. 154(b) by 236 days.

(21) Appl. No.: 14/710,503

(22) Filed: May 12, 2015

(65) Prior Publication Data

US 2015/0320636 A1 Nov. 12, 2015

Related U.S. Application Data

(60) Provisional application No. 61/991,896, filed on May 12, 2014.

(51) Int. Cl.

| | |
|---|---|
| ***A61H 23/02*** | (2006.01) |
| ***A61H 19/00*** | (2006.01) |
| *A61H 7/00* | (2006.01) |

(52) U.S. Cl.

CPC ..... *A61H 23/02* (2013.01); *A61H 19/34* (2013.01); *A61H 19/44* (2013.01); *A61H 19/50* (2013.01); *A61H 23/0254* (2013.01); *A61H 7/007* (2013.01); *A61H 2201/0207* (2013.01); *A61H 2201/0214* (2013.01); *A61H 2201/165* (2013.01); *A61H 2201/1645* (2013.01); *A61H 2201/501* (2013.01);

(Continued)

(58) Field of Classification Search

CPC ..... A61H 19/34; A61H 19/50; A61H 2201/0157; A61H 2205/087; A61H 23/0254; A61H 2201/0153; A61H 2201/1628; A61H 2201/165; A61H 23/0263; Y10S 601/16

See application file for complete search history.

(56) References Cited

U.S. PATENT DOCUMENTS

| | | | |
|---|---|---|---|
| 6,056,705 | A | 5/2000 | Stigar-Brown |
| 6,179,775 | B1 | 1/2001 | Thompson |

(Continued)

FOREIGN PATENT DOCUMENTS

| | | |
|---|---|---|
| WO | WO 2013/108244 | 7/2013 |

OTHER PUBLICATIONS

International Preliminary Report on Patentability (Chapter I of the Patent Cooperation Treaty), for International Application No. PCT/US2015/030428, dated Nov. 24, 2016, 7 pages.

(Continued)

*Primary Examiner* — Christine H Matthews

(74) *Attorney, Agent, or Firm* — Fish & Richardson P.C.

(57) ABSTRACT

This disclosure relates to devices and method for producing stimulation to the clitoris of a user. In certain aspects, the vibrator device includes a vibrator mechanism and a body enclosing the vibrator mechanism. The body includes a first side member and a second side member. During use, the first side member and second side member are configured to engage in an interference fit with labia such that the body is in contact with a clitoris without obstructing the vaginal opening.

27 Claims, 9 Drawing Sheets

(52) U.S. Cl.
CPC ..... *A61H 2201/5025* (2013.01); *A61H 2201/5046* (2013.01); *A61H 2201/5061* (2013.01); *A61H 2201/5071* (2013.01); *A61H 2201/5082* (2013.01); *A61H 2201/5092* (2013.01); *A61H 2201/5097* (2013.01); *A61H 2230/505* (2013.01); *A61H 2230/605* (2013.01)

(56) References Cited

U.S. PATENT DOCUMENTS

| | | | | |
|---|---|---|---|---|
| 6,224,541 | B1 | 5/2001 | Thompson | |
| 6,923,755 | B2 | 8/2005 | Norma | |
| 8,579,837 | B1 | 11/2013 | Makower et al. | |
| 2003/0195441 | A1 | 10/2003 | Firouzgar | |
| 2005/0124853 | A1* | 6/2005 | Norma | A61H 19/34 600/38 |
| 2011/0257473 | A1 | 10/2011 | Torla | |
| 2012/0197072 | A1 | 8/2012 | Cordle | |
| 2013/0109913 | A1* | 5/2013 | Imboden | A61H 1/00 600/38 |

OTHER PUBLICATIONS

Notification of Transmittal of the International Search Report and the Written Opinion of the International Searching Authority, or the Declaration issued in related International Application No. PCT/US15/30428 dated Aug. 14, 2015, 13 pages.
Extending European Search Report issued in corresponding EP Application No. 15793561.0 dated Dec. 11, 2017, 7 pages.

* cited by examiner

VIBRATING ELECTROMECHANICAL DEVICE FOR FEMALE STIMULATION

CROSS-REFERENCE TO RELATED APPLICATIONS

This application claims benefit from U.S. Provisional Patent Application No. 61/991,896, filed on May 12, 2014.

TECHNICAL FIELD

This invention relates to vibrating electromechanical devices for female stimulation.

BACKGROUND

The invention relates to the field of sexual stimulation, and more particularly to clitoral stimulation. Vibrating electromechanical devices, sometimes referred to as vibrators, can be used to help facilitate women reaching orgasm. Couples may also choose to use a vibrator to enhance the pleasure of one or both partners.

SUMMARY

This disclosure relates to devices and methods for producing stimulation to the clitoris of a user in which the apparatus is held in place above the vaginal opening through an interference fit with the labia. Many of the devices and methods are compatible with sexual intercourse because stimulation is provided to the clitoris while the vaginal opening remains accessible.

In one aspect of the invention, a vibrator device to stimulate the clitoris of the user includes a vibrator mechanism and a body enclosing the vibrator mechanism. The body includes a first side portion, a second side portion, and an extension portion. The first side portion and second side portion are configured to engage in an interference fit with labia of the user such that the device is in contact with a clitoris.

In another aspect of the invention, a vibrator device stimulates a clitoris of a user includes a vibrator mechanism and a body enclosing the vibrator mechanism. The body includes a first side member and a second side member. The first side member and second side member are configured to engage in an interference fit with labia of the user such that the body is in contact with the clitoris of the user.

In yet another aspect of the invention, a method of applying vibration to a clitoris of a user. The method includes positioning a vibrator device on the user such that the first side member and second side member engage in an interference fit with a labia and such that the vibrator device engages in an interference fit with labia of the user such that the vibrator device is in contact with a clitoris and a vaginal opening of the user is unobstructed.

In another aspect of the invention, a method includes applying vibration to the clitoris of a user. The method includes a vibrator device having a vibrator mechanism and a body enclosing the vibrator mechanism. The body includes a first side portion, a second side portion, and an extension portion. The vibrator device is positioned by a user such that the first side portion and second side portion engage in an interference fit with labia and such that the extension portion is in contact with a clitoris and the vibrator device does not obstruct the vaginal opening.

In some implementations, the device includes a controller enclosed within the body and attached to the vibrator mechanism.

In some implementations, the device includes a controller electronically connected to the vibrator mechanism.

In certain implementations, the device includes a transceiver electronically connected to the controller.

In some implementations, the transceiver is adapted to communicate with Bluetooth-enabled devices.

In some implementations, the transceiver is adapted to communicate wirelessly.

In certain implementations, the vibrator mechanism is enclosed within the extension portion.

In some implementations, the device is configured to engage outside the vaginal opening during use.

In certain implementations, the device includes at least one vibration motor.

In some implementations, the vibration motor is a pancake motor.

In certain implementations, the body includes a material and any of the first side portion and second side portion includes a material different that differs from the body material.

In some implementations, the body includes at least one open portion.

In certain implementations, the body includes at least one raised portion.

In some implementations, the body includes at least one depressed portion.

In certain implementations, the body is arranged to have a concave curve corresponding to an anatomical curve.

In some implementations, the side portions further comprise at least one adjustable element.

In some implementations, at least one of the side members further comprise at least one adjustable element.

In certain implementations, the adjustable element is a spring.

In some implementations, the method includes a vibrator mechanism enclosed within the extension portion.

In certain implementations, the method includes a vibrator device that includes at least one vibration motor.

In some implementations, the method includes a vibration motor that is a pancake motor.

In certain implementations, the method includes a vibrator device further including a controller enclosed within the body and attached to the vibrator mechanism.

In some implementations, the method includes a vibrator device further including a transceiver electronically connected to the controller.

In certain implementations, the method includes a transceiver that is adapted to communicate with Bluetooth devices.

In some implementations, the method includes a transceiver that is adapted to communicate wirelessly.

In some implementations, the method includes applying vibration to the clitoris of a woman, the method including providing a vibrator device described herein and positioning the vibrator device on a user such that the first side portion and second side portion engage in an interference fit with a labia and such that the extension portion is in contact with a clitoris. The vibrator device does not obstruct the vaginal opening.

In certain implementations, the method includes activating the vibrator device. The vibrator device is configured to provide stimulation to the clitoris of the user.

In some implementations, the method further includes penetrating the vaginal opening of the user with an object.

In certain implementations, the method further includes simultaneously providing stimulus to the clitoris and penetrating the vagal opening of the user.

In some implementations, the object is a penis or a dildo.

Other aspects, features, and advantages will be apparent from the description and drawings, and from the claims.

DESCRIPTION OF DRAWINGS

The foregoing and other objects, features, and advantages of the invention will become more apparent from a reading of the following description in connection with the accompanying drawings.

DETAILED DESCRIPTION

Described herein are devices and methods for producing sexual stimulation, and more specifically to a vibrating device designed to stimulate the clitoris. The devices described herein are designed to fit the anatomy of a range of women and remain in contact with the clitoris without obstructing the vaginal opening. This permits the use of the devices during intercourse. This also permits device operation without the need for additional devices and/or the hands of a user to ensure that the device remains in position.

Figure 1A:
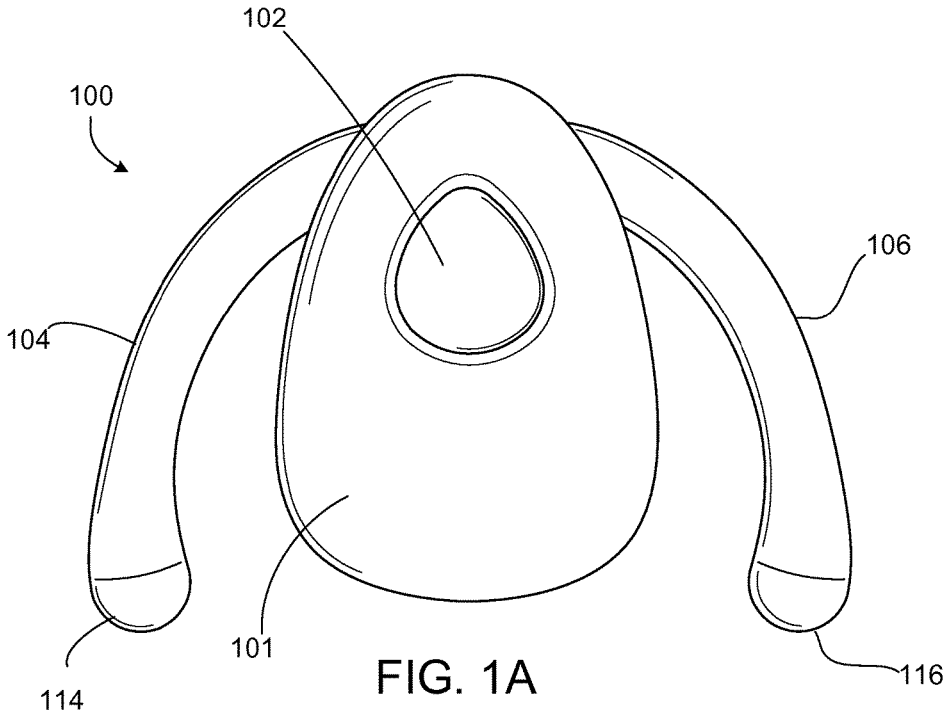
FIG. 1A is a front view of a vibrating electromechanical device.
Figure 1B:
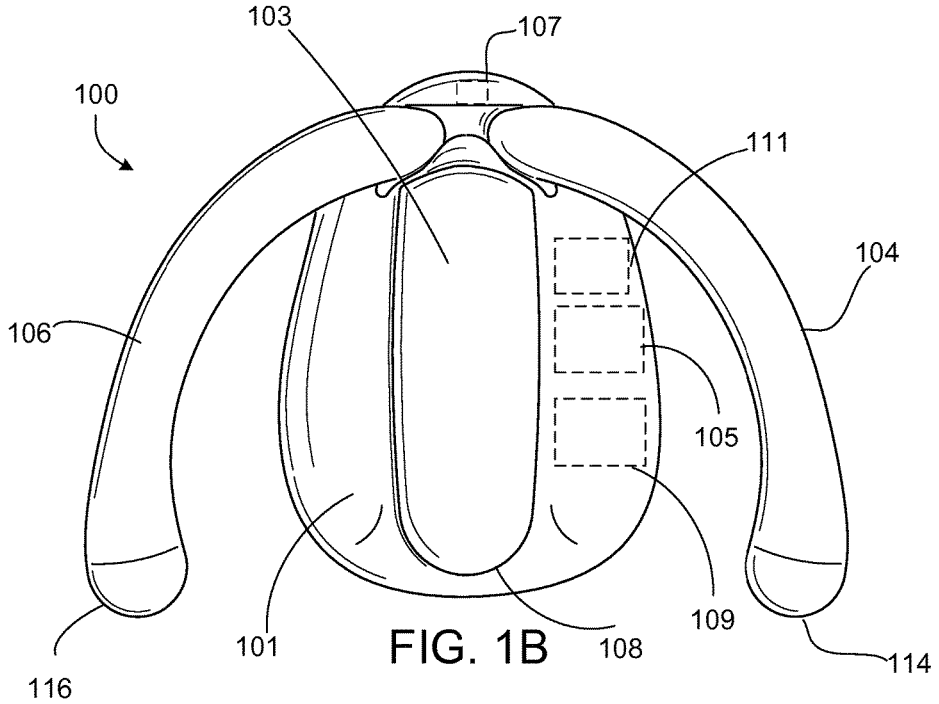
FIG. 1B is a back view of the device of FIG. 1A.

Referring to FIGS. 1A and 1B, a device 100 for mechanically stimulating a clitoris is shown. The device 100 includes a body 101 generally having a button 102, a vibrating mechanism 103, side members 104, 106, a controller 105, a port 107, a transceiver 109, and a power source 111. The controller 105 and the transceiver 109 are shown as visible in FIG. 1B for the purposes of illustration. However, generally the body 101 encapsulates the controller 105 and the transceiver 109. As explained in detail below, during use, the device 100 is configured to contact the clitoris and engage in an interference fit between the labia of the user.

As shown in FIGS. 1A and 1B, the geometric configuration of the device is initially symmetrical around the vertical axis. The side members 104, 106 extend away from the body 101 in a direction perpendicular to the body 101 until the side members 104, 106 are parallel to the apex of the vibrating mechanism 103 and curve outward from the body 101 in a direction parallel to the body 101. The side members 104, 106 terminate in free ends 114, 116, respectively. The curvature of the side members 104, 106 are arranged to conform to the anatomy of a vulvar vestibule to engage in an interference fit between the labia of a user. In some examples, the side members 104, 106 are removably attached to the body 101. In some examples, the side members 104, 106 are available in multiple sizes and/or configurations to help accommodate anatomical variations between various users. In these examples, the user can customize the fit of the device by selecting and attaching a desired side arm configuration.

The body 101 includes a raised portion 108 extending outward from the body 101. The raised portion 108 can enclose the vibrating mechanism 103. By extending outward from the body 101, the raised portion 108 can contact the clitoris and provide stimulation directly to the clitoris of the user. In some cases, the height to width ratio of the raised portion 108 is less than about 1 (e.g., less than about 0.9, less than about 0.8, less than about 0.7, less than about 0.6, less than about 0.5, less than about 0.4, less than about 0.3, less than about 0.4, or less than about 0.1).

In other cases, the height to width ratio of the raised portion 108 is at least about 3 (e.g., at least about 1.1, at least about 1.2, at least about 1.3, at least about 1.4, at least about 1.5, at least about 1.6, at least about 1.7, at least about 1.8, at least about 1.9, at least about 2, or at least about 2.5). In other cases, the length to width ratio of the raised portion 108 is at least about 1 (e.g., at least about 1.2, at least about 1.4, at least about 1.6, at least about 1.8, at least about 2, at least about 2.2, at least about 2.4, at least about 2.6, at least about 2.8, at least about 3, at least about 3.2, at least about 3.4, at least about 3.6, at least about 3.8, or at least about 4).

The proportions of the side members and size of the device as a whole can be adjusted to correspond to the anatomy of a particular user or group of users. For example, the side members 104, 106 can be configured to project from the body 101 for a sufficient distance to enable device contact with the clitoris. In some examples, the side members 104, 106 may extend for a sufficient distance to ensure an interference fit is achieved with the labia.

In some cases, the ratio of the height of the body 101 to the width of the device can be at least about 0.5 (e.g., at least about 0.70, at least about 1.2, at least about 1.4, at least about 1.6, at least about 1.8, at least about 2, at least about 2.2, at least about 2.4, at least about 2.6, at least about 2.8, at least about 3, at least about 3.2, at least about 3.4, at least about 3.6, at least about 3.8, or at least about 4).

The side members 104, 106 assume an initial configuration in which the side members 104, 106 extend from the body 101 as shown in FIGS. 1A and 1B. During use, as the labia and/or other anatomical features exert a force on the side members 104, 106, the side members 104, 106 compress towards the center of the device 100. In this example, the side members 104, 106 exert a reactionary force on the anatomy in response to the varying forces exerted on the side members 104, 106 during use. This allows the side members 104, 106 to self-adjust to secure the device and to accommodate the user's movement during use. For example, during use the device 100 is temporarily secured within the vulvar vestibule by the force exerted by the labia and the reactionary force of the side members. However, once the device is removed from use, the side portions revert to the initial configuration.

In some cases, the width of the device, including the body 101 and the side members 104, 106 is less than about 7 cm (e.g., less than about 6.35 cm, less than about 6.5 cm, less than about 6 cm, less than about 5.5 cm, less than about 5 cm, less than about 4.5 cm, less than about 4 cm, less than about 3.5 cm, less than about 3 cm, less than about 3.4 cm, less than about 3.3 cm, less than about 3.2 cm, less than about 3.1 cm, less than about 3 cm, less than about 2.8 cm, less than about 2.6 cm, less than about 2.4 cm, less than about 2.2 cm, or less than about 2 cm).

In some cases, the device 100 can have a total thickness sufficient to encapsulate at least one of the following: the vibrating mechanism 103, the controller 105, the port 107, the transceiver 109, and the power source 111. For example, the device can have a thickness of about 1 cm, about 1.5 cm, about 2 cm, about 2.5 cm, about 3 cm, about 3.2 cm, about 3.5 cm, about 4 cm, about 4.5 cm, about 5 cm, or about 5.5 cm.

The body 101 of the device 100 can be formed of a wide range of materials (e.g., rubber, gel foams, plastics, silicone, and/or other suitable materials). In some cases, device 100 includes a base material, e.g., forming an internal skeleton, and a coating material encasing the base material. The base material and the coating material can be formed of the same material. Alternatively, the base material and coating material can be different from each other. For example, the base material can be formed of a first material (e.g., nylon, silicone, Nylon PA6 and/or plastic) while the coating material can be formed of a second material (e.g., medical grade silicone, rubber, gel foams, or plastics). The base materials and/or the coating material are capable of withstanding sanitization methods. For example, the device 100 is constructed from a material and in such a manner as to be waterproof and/or water resistant. In other cases, the device 100 is compatible with automatic cleaning devices (e.g., a dishwasher).

The body 101 and the side members 104, 106 can be formed of the same material (e.g., rubber, gel foams, plastics, silicone, and/or other suitable materials). In some cases, at least a portion or the entire device may be formed of a more flexible material. For example, side members 104, 106 may be formed of a flexible shape-memory material while the body 101 can be formed of a less flexible plastic.

Referring to FIG. 1B, the vibrating mechanism 103 is encapsulated within the body 101. The vibrating mechanism 103 can provide clitoral stimulation using various techniques and technologies (e.g., vibration, oscillation, electrical stimulation, heat, cooling, linear actuation, planar movement of one or more stimulation points, rotary movement of one or more stimulation points, or a combination thereof). While the vibrating mechanism is generally described as providing vibrations, vibrations are an exemplary technique for providing clitoral stimulation.

In this example, the encapsulated vibrating mechanism 103 extends outwardly from the body 101 to contact the clitoris during use. The encapsulated vibrating mechanism 103 can causes the body 101 to serve as a vibration mass. In this example, the vibrations are transferred throughout the device 100 thereby causing the body 101 to vibrate against the clitoris. In some cases, a portion of the device 100 can serve as a vibration mass. The vibration can be transferred to selected portions of the device 100. These designated portions can then function as a vibration mass. For example, while the body 101 can receive vibrations to function as a vibration mass, one or more of the side arms 104, 106 can remain isolated from the vibrations. This arrangement can help to secure the device 100 by stabilizing the side arms 104, 106 and help to direct stimulation to a desired zone (e.g., the clitoris). The encapsulated vibrating mechanism 103 can transfer vibrations to the clitoris through direct contact. In other examples, the body 101 includes multiple motors. It should be understood that numerous mechanisms for producing vibrations would be obvious to one of ordinary skill in the art. For example, while a shaftless or pancake motor is generally preferred, other means of producing vibratory motion can be used.

The controller 105 is similarly encapsulated in the body 101. The controller 105 is configured to control the operation of the vibrating mechanism 103. In this example, the controller 105 switchably connects the vibrating mechanism 103 to the power source 111. The controller 105 may also allow the user to adjust the rate of speed and/or manner of vibration. Alternatively, the device may include a first "ON/OFF" controller for activating and deactivating the vibration-generating motor, and a second "variable speed switch" controller for controlling the rate and/or type of vibration. While the controller 105 is generally shown in the body 101, user controls (e.g., buttons and/or switches) can be directly or remotely connected to the controller 105. For example, the device 100 includes at least one button 102 in communication with the controller 105 to allow the user to control the device 100. The button 102 can use any of various technologies implementing momentary touch, pressure sensitive, resistive or capacitive touch, resistive or capacitive touchscreens, pressure sensitive touchscreens, knobs, switches, and light-sensitive mechanisms. Any of these technologies may be adapted to recognize multiple gestures, types of touches, multiple patterns of touches, or multiple duration of touch. In one example the device may have a single button that when momentarily pressed sequentially causes the unit to go from off to low, low to medium, medium to high, high to off over the course of four button presses. Similarly, a longer duration press may interrupt the button progression and override into some other state such as off.

In FIG. 1B, the port 107 is generally shown at the top of the device, those skilled in the art would appreciate that this port can be located at a variety of locations on the device. The device 100 may also include a port cover over the port 107 to protect the electronic components.

The power source 111 used to operate the device 100 (e.g., vibrating mechanism 103, the controller 105, the transceiver 109, or one or more sensors) can be one or more batteries positioned within the body 101. Alternatively, other suitable power sources can be used for providing the electrical power to the vibrating mechanism 103, including specific battery types, battery sizes, renewable batteries, rechargeable batteries, disposable batteries). The port 107 can be wired to communicate directly with controller 105. Alternative methods of charging well known in the art such as inductive, or capacitive charging may be substituted for USB charging. The device may further comprise an inductive or capacitive charging circuit and components (e.g., electrical connections compatible with the charging circuit) as is known in the art, such that the device may be charged by simply placing it in or on an inductive or capacitive charger.

Still referring to FIG. 1A, the transceiver 109 (e.g., a radio transceiver adapted to communicate with wireless devices, such as Bluetooth devices ("Bluetooth-enabled")) is contained in the body 101. The transceiver 109 is in electrical communication with the controller 105 and thus the vibrating mechanism 103. The controller 105 can be connected by wired (e.g., via the port 107, a wireless connections to a client device (not shown)) to other devices or internal components. The client device can be a computing device (e.g., mobile devices, desktop computers, laptops, cell phones, personal digital assistants ("PDAs"), iPhones, smart phones, iPads, iWatches, smartwatches, servers, or embedded computing systems). Other communication features can include one or more lights, speakers, or tactile feedback mechanisms on the device or external to the device. The client device and/or communication features can communicate information related to the state of the device, such as on/off, battery status charging, malfunction, additional vibrational modes, current vibrational mode (e.g., low, medium, high), speed, rotations per minute ("RPM"), relative scale of the vibration, and other information related to the device's operation or status.

If a wireless connection is provided, the wireless connection can be configured to provide an essentially real-time information relay between the device and the client device. For example, the client device displays in real-time the current status of the device (e.g., on, off, and/or a specific vibratory pattern or mode). Exemplary low latency wireless connections can be based on an IEEE 802.15 standard, such as the ZigBee communication protocol (other exemplary low latency protocols include ISA100.11a, WirelessHART, and MiWi specification). In another example, the device 100 may communicate through a short-range wireless connection with a computing device, such as using Bluetooth™ technology. The Bluetooth radio transceiver may be integrated into the device, as shown, or it may be coupled to the device. The port 107, which may include various communication ports (e.g., USB, Bluetooth, Ethernet, wireless Ethernet) may be coupled to one or more input/output devices, such as a networking device such as a switch or router (e.g., through a network adapter).

In some examples, the device 100 includes one or more sensors in communication with the controller 105 using a wired or wireless connection. The one or more sensors can be fully or partially embedded within the device 100 or external to the device 100. The one or more sensors can be used to collect information. For example, the device may make use of one or more image sensors (e.g., CCD, CMOS, or other image sensors), light sensors (e.g., a photoresistor or photodiode), ultrasound sensors (e.g., piezoelectric or magnetostrictive ultrasound sensors), electrodermal activity sensors, force sensors, strain gauges, motion and position sensors (e.g., accelerometers, gyroscopes, or magnetometer), temperature sensors (e.g., thermistors, thermocouples, resistance thermometers, infrared thermometers, or silicon bandgap temperature sensors), sound sensors (e.g., condenser, dynamic, ribbon, carbon, piezoelectric, fiber optic laser, bone conduction, ultrasonic, or MEMS), and/or atmospheric sensors.

The one or more sensors can provide information to the controller 105 via the wired or wireless connection. Based, at least in part, on this information, the controller 105 can control the device 100. For example, one or more image sensors can gather image data information, and the controller can receive this information for machine vision, including object detection and tracking, object recognition or rejection, object presence or absence, pattern recognition, motion analysis, or object distance. In another example, one or more light sensors can be positioned on the device such that the light sensor can sense the absence or presence of light and communicate this information to the controller. The controller 105 can control device operation in response to this information by, for example, automatically activating the device 100 in response to an absence of light. Likewise, the controller 105 can automatically deactivate the device 100 in response to the presence of light.

While certain embodiments have been described, other embodiments are possible.

Referring to FIGS. 2A-10B, for example, the side members 104, 106 can include various modifications to achieve device retention in other ways. In these examples, the side members 104, 106 are integrally formed with the body 101. Various features of the device 100 (e.g., the vibrating mechanism 103, the controller 105, the transceiver 109, or the port 107) have been omitted from FIGS. 2A-10B for clarity. Each of the features described with reference to the device 100 is contemplated with regards to the other devices described herein. Additional features are numbered and discussed below for clarity.

Figure 2A:
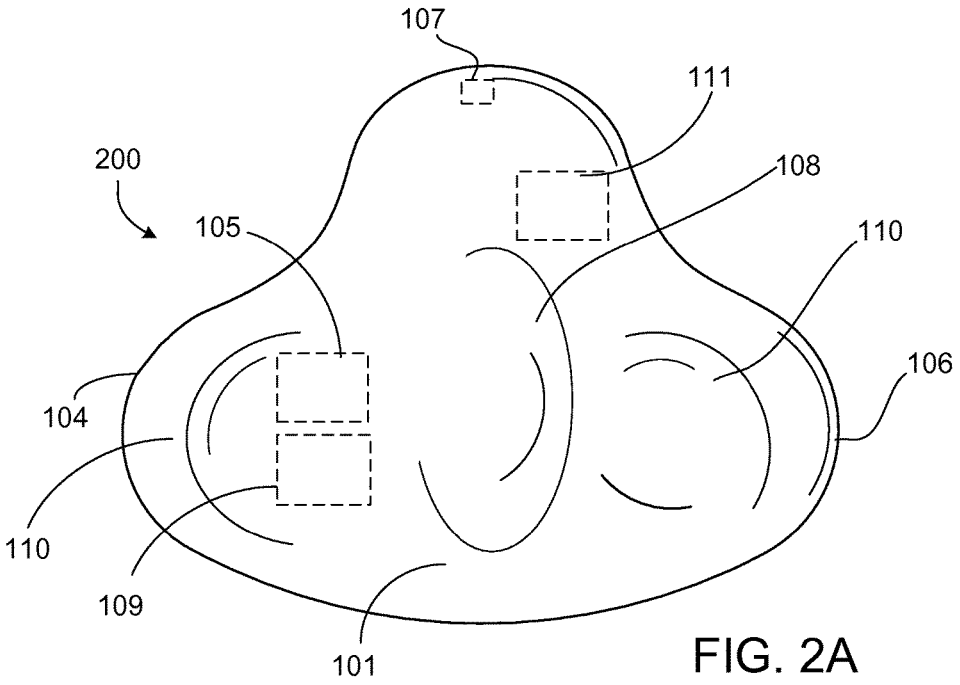
FIG. 2A is a front view of a vibrating electromechanical device.
Figure 2B:
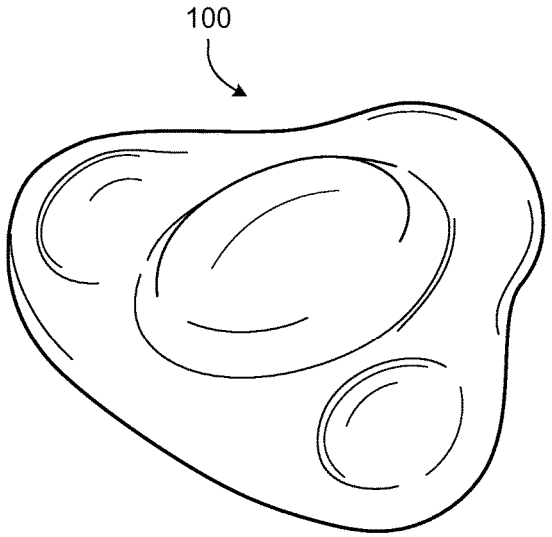
FIG. 2B is a perspective view of the device of FIG. 2A.

As shown in FIGS. 2A and 2B, in some implementations, the device 200 can optionally include at least one or a combination of concave depressions 110 in the body 101 to help facilitate a secure connection to the anatomy. In some examples, the concave depressions 110 have a depth of less than about 95% (e.g., less than about 90%, less than about 80%, less than about 70%, less than about 60%, less than about 50%, less than about 40%, less than about 30%, less than about 20%, less than about 10%, less than about 5%, or less than about 1%) of the total thickness of the device.

In some examples, the raised portion 108 has a height of less than about 95% (e.g., less than about 90%, less than about 80%, less than about 70%, less than about 60%, less than about 50%, less than about 40%, less than about 30%, less than about 20%, less than about 10%, less than about 5%, or less than about 1%) of the total thickness of the device. In some examples, the concave depressions 110 occupy less than about 95% (e.g., less than about 90%, less than about 80%, less than about 70%, less than about 60%, less than about 50%, less than about 40%, less than about 30%, less than about 20%, less than about 10%, less than about 5%, less than about 4%, less than about 3%, less than about 2%, less than about 1%, or less than about 0.5%) of the surface area of the device.

Figure 3A:
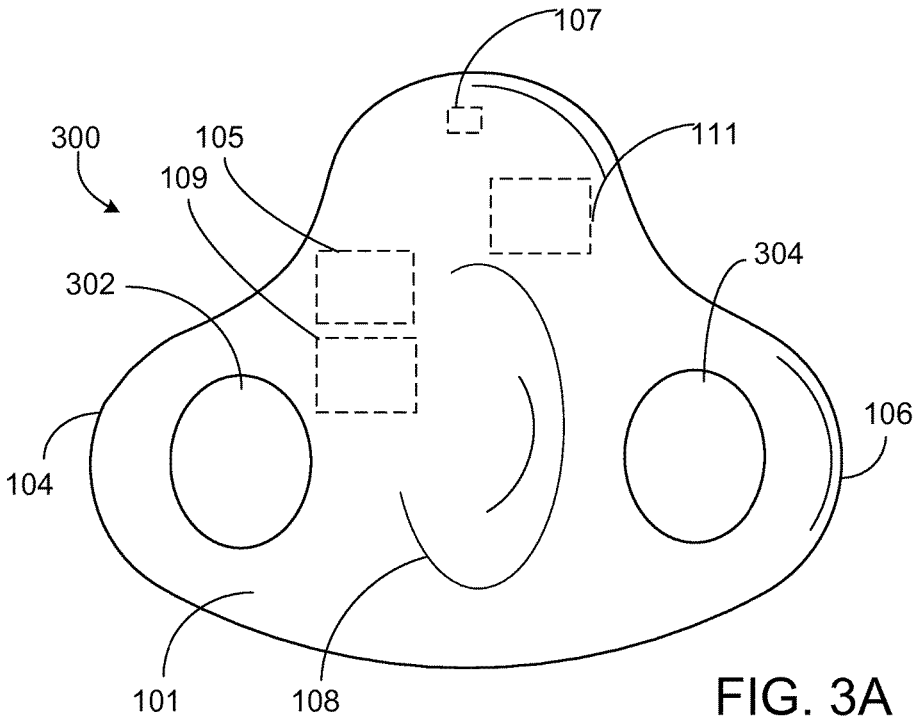
FIG. 3A is a front view of a vibrating electromechanical device having open portions.
Figure 3B:
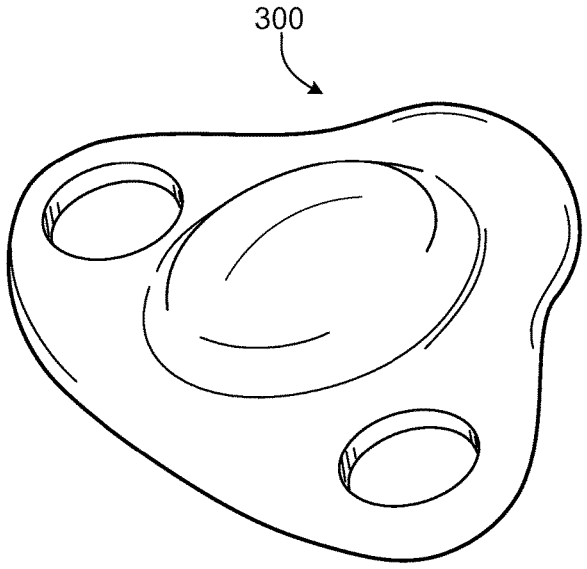
FIG. 3B is a perspective view of the device of FIG. 3A.

As shown in FIG. 3B, the device 300 is configured to exhibit a slight concave and/or curved arrangement. This configuration facilitates intimate contact with the anatomical structure of a female, particularly to facilitate intimate contact of the body 101 with the clitoris. The radius of curvature can be adjusted based on the particular anatomical structure of a user or a group of users. In some cases, the radius of curvature is configured to facilitate contact with the anatomy.

In some cases, the depth to width ratio of the concave depressions 110 is less than about 1 (e.g., less than about 0.9, less than about 0.8, less than about 0.7, less than about 0.6, less than about 0.5, less than about 0.4, less than about 0.3, less than about 0.2, or less than about 0.1). In other cases, the depth to width ratio of the concave depressions 110 is at least about 1 (e.g., at least about 1, at least about 1.1, at least about 1.2, at least about 1.3, at least about 1.4, at least about 1.5, at least about 1.6, at least about 1.7, at least about 1.8, at least about 1.9, or at least about 2). The body 101 can optionally include the raised portion 108 (e.g., encasing the vibrating mechanism 103).

In some examples, the device 300 includes openings 302, 304. These openings can be free of material and/or consist of a lighter and/or more flexible material. In some cases, the openings 302, 304 are oval in shape and have a length to width ratio (e.g., at least about 1, at least about 1.5, at least about 2, at least about 2.5, at least about 3, at least about 3.5, at least about 4, at least about 4.5, at least about 5, at least about 5.5, or at least about 6). In other cases, each of the openings 302, 304 are circular in shape and occupy less than about 90% (e.g., less than about 80%, less than about 70%, less than about 60%, less than about 50%, less than about 40%, less than about 30%, less than about 20%, less than about 10%, or less than about 4%) of the total surface area of the device. In some cases, the side members 104, 106 are arcuate portions connected to the body 101 at locations along the length of the arcuate side members 104, 106. In this manner, openings (e.g., the openings 302, 304, can be formed between the connected portions. These openings 302, 304 can be manipulated to adjust the overall weight and/or resonant mass of the device and the resistance offered by the side members 104, 106.

Figure 4:
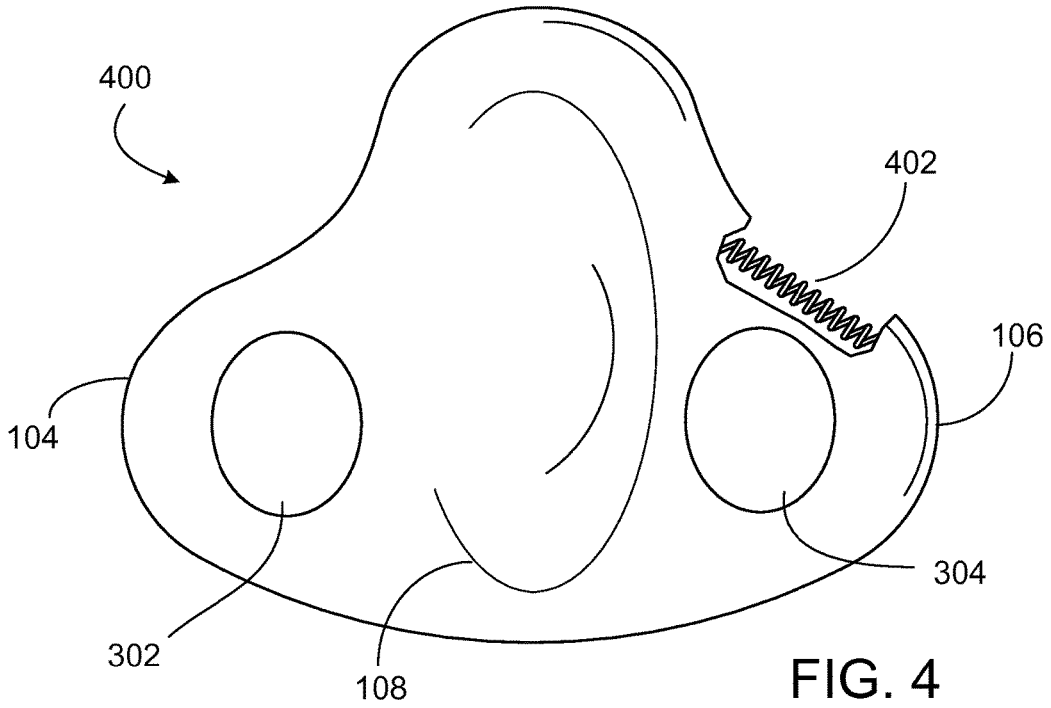
FIG. 4 is a front view of a vibrating electromechanical device having a cutaway portion showing an internal spring member.

As shown in FIG. 4, the side members 104, 106 can include an internal resistance members 402 (e.g., a spring) encapsulated therein. For simplicity, only one of the resistance members is shown in FIG. 4, but it will be understood that each of the side members 104, 106 contains the same type of resistance member. In other examples, the device 400 includes an internal resistance member 402 (e.g., a spring). In this example, the spring force used can be adjusted to permit the spring to compress during use, yet still exert sufficient reactionary force on the labia to anchor the device in place.

In this example, the side members 104, 106 are formed of a flexible material to deform as the resistance members compress and return to their original configurations as the resistance members release Thus, the side members 104, 106 move in combination with the resistance members 402. In some cases, the resistance members 402 extends along a portion of the external edge of the side members 104, 106. In other cases, the encapsulated resistance members 402 connects the side members 104, 106 to the body 101.

In some cases, the resistance members 402 are capable of adjusting the reactionary force in response to the varying forces exerted on the side portions during use. For example, the springs would self-adjust to accommodate the user's movement during use. While a spring is generally shown, it should be understood that other types of elastic or resilient components could alternatively be used.

Figure 5:
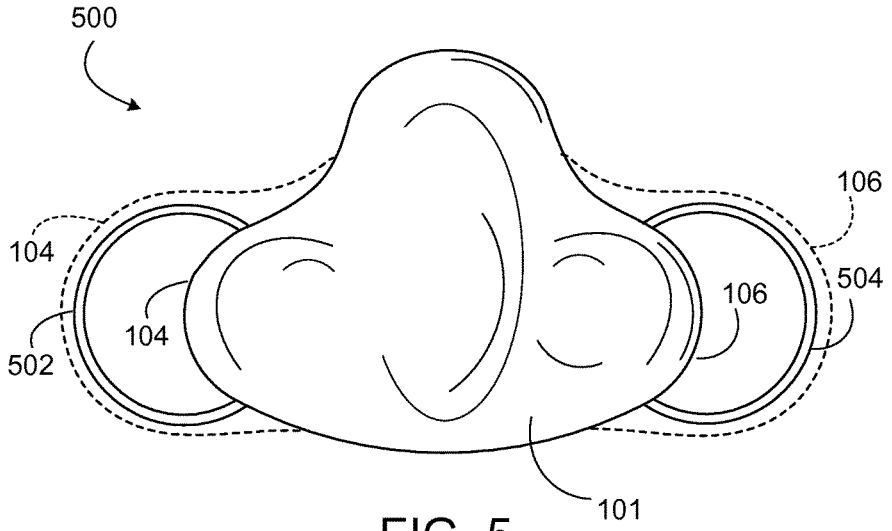
FIG. 5 is a front view of a vibrating electromechanical device including encased-projecting members each having an arced shape and each having an end connected to the electromechanical device.
Figure 6:
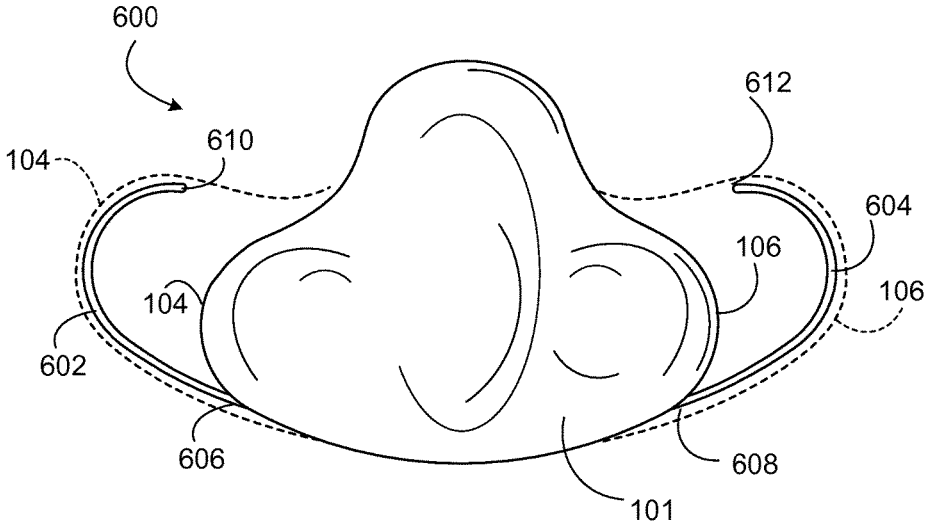
FIG. 6 is a front view of a vibrating electromechanical device including encased-projecting members each having an arced shape and each having one end that is not connected to the electromechanical device.

In some examples, as shown in FIG. 5, the device 500 includes the side members 104, 106 encasing an encased-projecting member 502, 504. The encased-projecting member 502, 504 is formed of a flexible material and is compressible. During use the encased-projecting members 502, 504 are compressed within the side members 104, 106 by the labia. As such, the encased-projecting members 502, 504 facilitate an interference fit with the labia of the user. As shown in FIG. 5, each of the encased-projecting members 502, 504 is an arcing member with each end connected to the body 101. In certain cases, the arcing members connect with the body 101 and the side members 104, 106. In other examples, the encased-projecting members are encased within the device 500 and connected to the body 101 at one contact point. For example, referring to FIG. 6, the device 600 includes encased-projecting members 602, 604 shown as arcing members that are each encased within the device and connected to the body 101 via a single contact point (e.g., at each connected end 606, 608 respectively). During use, an unconnected end 610, 612 and/or a connected end 606, 608 may temporarily compress towards the body 101 due to the compression of the encased-projecting member 602, 604 between the labia.

Figure 7:
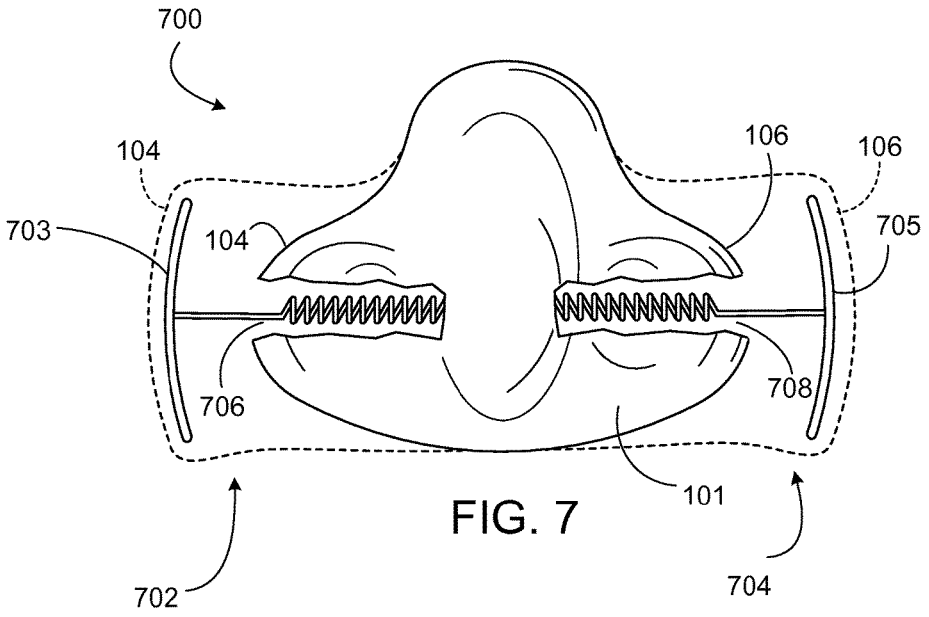
FIG. 7 is a front view of a vibrating electromechanical device including encased-projecting members each having a curved portion, and a cutaway portion showing internal spring members.

In other examples, as shown in FIG. 7, the device 700 includes side portions 702, 704 encasing projecting members 703, 705. Each of the encased-projecting members 703, 705 includes a curved portion and an internal resistance member 706, 708. The internal resistance member 706, 708 extends along at least a portion of the device 700 and is connected to the associated encased-projecting member 703, 705. As shown in FIG. 7, the internal resistance member 706, 708 can be a spring member, but other elastic mechanisms can be used. In this example, the spring force used can be adjusted to permit the spring to collapse during use, yet still exert sufficient reactionary force on the labia to anchor the device in place. For example, during use, the internal resistance members 706, 708 compress within the side portions 702, 704 as the labia exerts force on the curved portion via the side members 104, 106 and return to an original configuration after use. Thus, the length of the each of the encased-projecting members 703, 705 can be reduced in response to a compressive force exerted by the labia on the side members 104, 106.

Still referring to FIG. 7, the curved portions of the encased-projecting members 703, 705 are configured to press against the labia of a user via the side members 104, 106. For example, during use, the side members 104, 106 compress towards the body 101 in response to forces exerted by the labia of the user. The curved configuration of the device 700 facilitates intimate contact with the anatomical structure of a female, thereby facilitating intimate contact of the body 101 with the clitoris. The radius of curvature can be adjusted based on the particular anatomical structure of a user or a group of users to enhance the inference fit between the device and the labia and/or to enhance the comfort of the fit to the user. In some cases, the radius of curvature is configured to facilitate contact with the anatomy.

Figure 8:
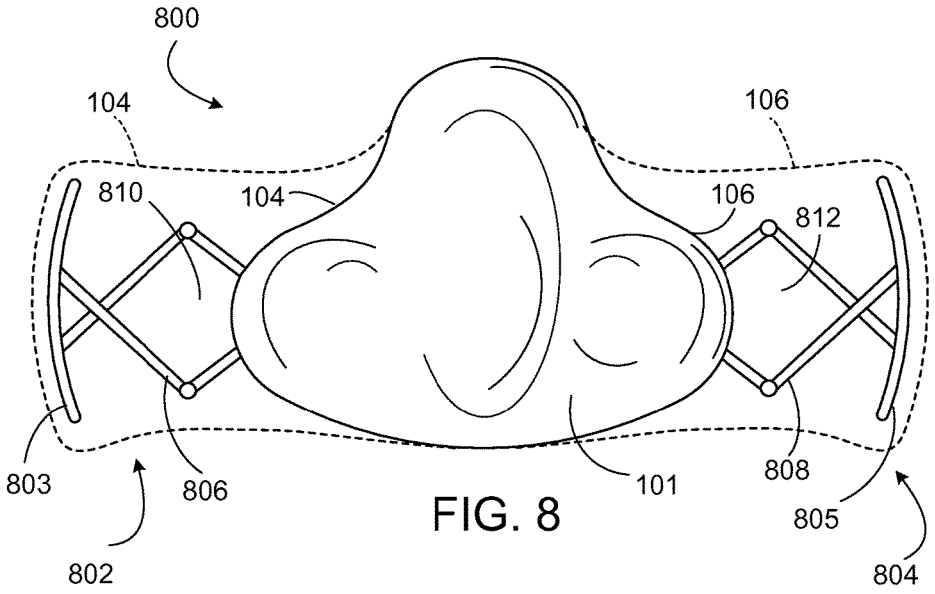
FIG. 8 is a front view of a vibrating electromechanical device including encased-projecting members each having curved portions connected to an adjustment portion.

In other examples, as shown in FIG. 8, the body 101 of the device 800 includes the adjustment portions 802, 804 encasing projecting members 803, 805. Each of the encased-projecting members 803, 805 includes a curved portion connected to an adjustment portion 802, 804. The adjustment portions 802, 804 are configured to have an adjustable length. For example, the length of the adjustment portions 806, 808 reduces as the adjustment portions 802, 804 fold in an accordion-like manner (e.g., the width of a cells 810, 812 reduces). While open cells 810, 812 are shown, a closed cell is also contemplated. Thus, the length of the encased-projecting members 806, 807 varies in accordance with the length of the adjustment portion 806, 808.

In some cases, the configuration and material of the adjustment portions 802, 804 are selected such that, during use, the forces exerted by the labia via the side members 104, 106 do not cause the adjustment portions 802, 8084 to substantially fold in an accordion-like manner. However, a user is able to manually adjust the lengths of the adjustment portions 802, 804 during placement (e.g., by enabling the expansion or compression of the adjustment portion 806, 808). For example, during placement a user could pull the adjustment portions 806, 808 in a direction away from the body 101 until the device assumes a comfortable and secure interference fit with the labia of a user.

Figure 9:
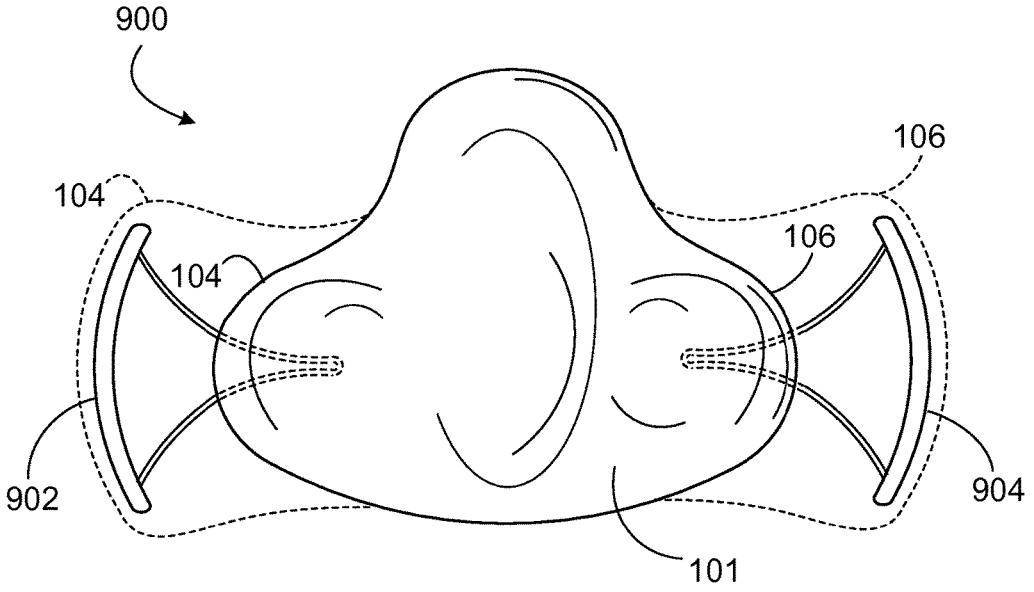
FIG. 9 is a front view of a vibrating electromechanical device including encased-projecting members each having an irregular-shaped member with curved edges and a portion of the irregular-shaped member encapsulated within the body portion.

In some examples, as shown in FIG. 9, the device 900 includes the side members 104, 106 encasing a projecting member 902, 904. The encased-projecting member 902, 904 is formed of a flexible material and is compressible. For example, during use the encased-projecting member 902, 904 is compressed towards the body 101 by the labia via the side members 104, 106. As such, the encased-projecting member 902, 904 facilitates an interference fit with the labia of the user. As shown in FIG. 9, the encased-projecting members 902, 904 can be irregular-shaped members having curved edges with a portion of the irregular-shaped members encased within the body 101. In certain cases, at least one portion of the irregular-shaped members 902, 904 are encased in the body 101, the body 101, and/or the side members 104, 106.

Figure 10A:
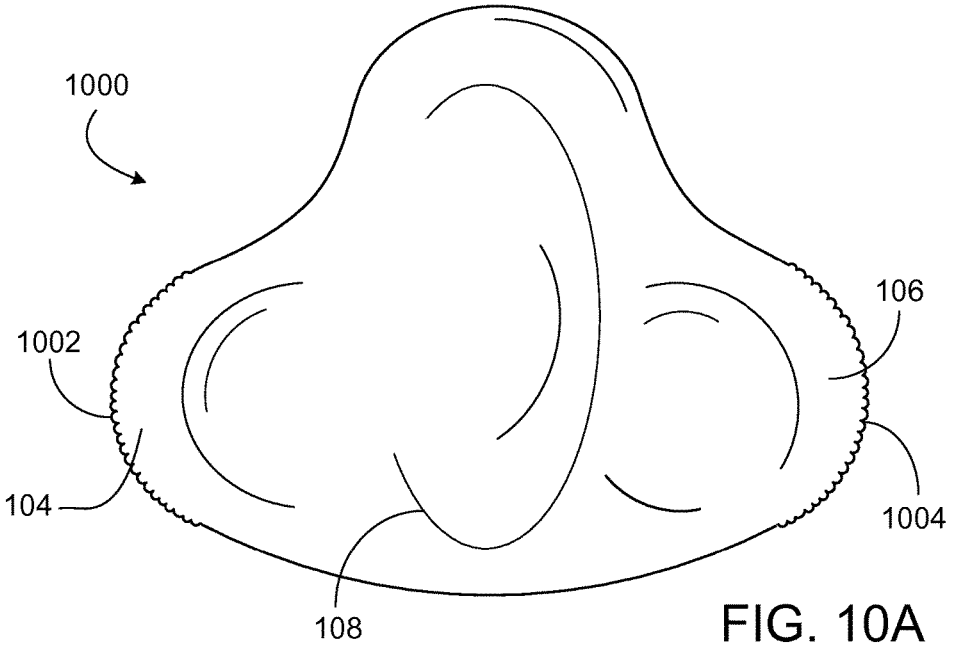
FIG. 10A is a front view of a vibrating electromechanical device having coated side portions.
Figure 10B:
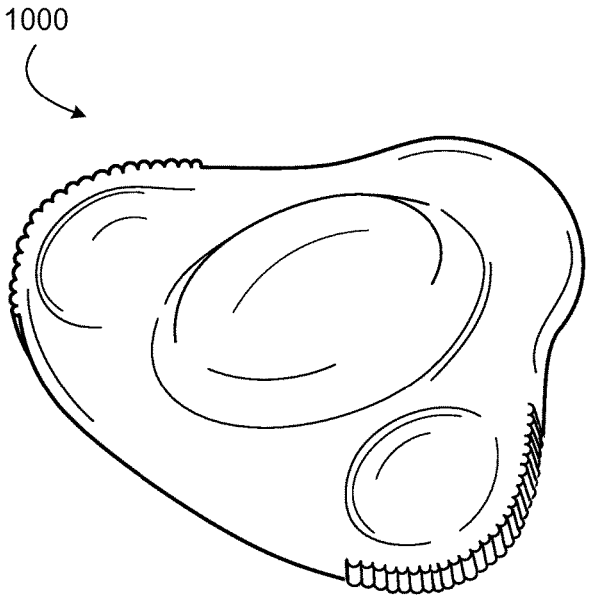
FIG. 10B is a perspective view of the device of FIG. 10A.

In other examples, as shown in FIG. 10A, the device 1000 can include side members 104, 106, a surface treatment (e.g., having a coating or material alteration), 1002, 1004 that exhibits a coefficient of friction with the labia that is higher than the coefficient of friction between the remaining material on the body 101 and the labia. As shown in FIG. 10B, device 1000 can be configured to exhibit a slight concave and/or curved arrangement. This configuration facilitates intimate contact with the anatomical structure of a female, particularly to facilitate intimate contact of the body 101 with the clitoris. The radius of curvature can be adjusted based on the particular anatomical structure of a user or a group of users. In some cases, the radius of curvature is configured to facilitate contact with the anatomy.

While the devices and methods generally described position the devices in contact the clitoris while engaged in an interference fit between the labia of the user without the need for additional devices and/or the hands of a user, additional devices may be employed. For example, straps, harnesses, or garments (e.g. retention devices) may be employed to additionally assist the interference fit between the labia of the user. The shape of retention devices may be specially adapted to accommodate the shape of the devices, such as with pouches, sized-openings, collars, clips, hooks, latches, buttons, zippers, toggles, anchors, magnets, slots, or keyholes. The retention devices can include material compatible with device insertion, retention, and/or positioning of the retention device. For example, a retention device having the general form of a belt could be formed a combination of leather and nitrile rubber. In such an example, the leather can be arranged adjacent to the pubic area of a user, and the nitrile adjacent to the labia to help secure the device. In other examples, the retention device could include an undergarment specially adapted with features designed to engage with the device and hold the device in place during sexual intercourse, while leaving an opening for vaginal penetration. Such an undergarment could be formed of various suitable materials (e.g., a cloth, latex, or nitrile rubber garment) with a properly sized opening near the clitoris to retain the device, with an opening sized and positioned enable vaginal penetration. In some examples, the device may be adapted to interface with the retention device through, for example, protrusions on the body 101 of the device.

Additionally or alternatively, the body 101 of the device may provide attachment features such as clips, anchors, slots, depressions, keyholes, or the like adapted to attach and release the device from the retention device. These attachments features can be formed from materials such as natural or synthetic fabric, rubber, plastic, latex, nitrile rubber, hook and loop fastener, silicone, or leather.

Figure 11:
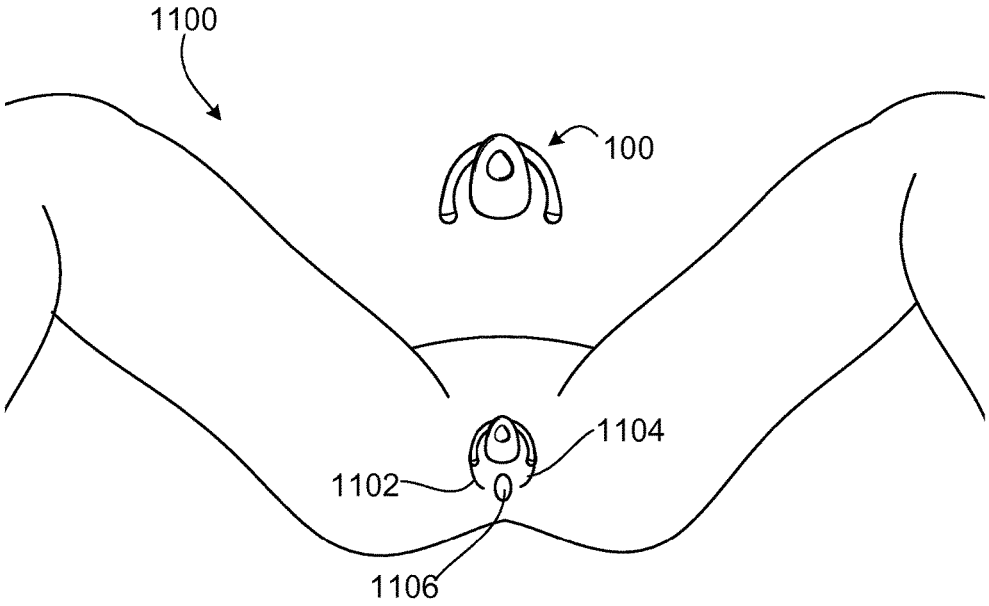
FIG. 11 is a perspective view showing the device of FIGS. 1A and 1B in use.

The operation of the devices 100, 200, 300, 400, 500, 600, 700, 800, 900, and 1000 will now be described with reference to the figures and specifically FIG. 11. In operation, the devices described herein are held by a user's anatomy (e.g., in a hands-free manner). In examples where the device includes a controller having a physical switch (e.g., a switch in the port 107 or the button 102), the user may turn the device on and/or select the vibration mode and/or intensity before or during use. In examples where the device is remotely controlled (e.g., over Wi-Fi or Bluetooth), the user may choose to first activate the device or apply the device. Various vibration patterns are contemplated. For example, the device can include a continuous vibration mode, an intermittent vibration mode, a high intensity mode, a medium intensity mode, a low intensity mode, or an escalating intensity mode. In some examples, the intensity mode is configured to escalate the intensity incrementally over time. By increasing the intensity incrementally, the pattern can mirror the onset of female arousal (e.g., by increasing in intensity in proportion to an increase in female arousal).

To use the device, the user places the device between labia 1102, 1104 in contact with the vulvar vestibule ensuring that the body 101 is in contact with the clitoris and the side portions press firmly against the labia. This contact with the labia provides an interference fit with the anatomy and temporarily restrains the device in place. As shown in FIG. 11, the device is configured to remain above the vaginal opening 1106. Thus, the device can be used during intercourse. For example, the body 101 can be positioned and activated to provide stimulation to the clitoris of a user. Simultaneously or separately, the user can participate in sexual intercourse including vaginal penetration by a penis or other object (e.g., a dildo). The devices described herein are then able to provide mechanical stimulation to the external genitalia (e.g., the clitoris of a woman) without the need for a partner and/or the user to hold the device in place. Once the user has completed the sexual activity, the user can then either manually or remotely turn the device off.

A number of exemplary embodiments of the invention have been described. Nevertheless, it will be understood by one of ordinary skill in the art that various modifications may be made without departing from the spirit and scope of the invention.

What is claimed is:

1. A vibrator device to stimulate a clitoris of a user, the device comprising:

a vibrator mechanism;

a body enclosing the vibrator mechanism; and a first side member and a second side member extending from the body in a manner such that at least a portion of the body that is configured to vibrate in response to activation of the vibrator mechanism is disposed between the first and second side members, wherein the first side member and the second side member are configured to deflect inwardly due to a force compressing the first and second side members towards a center of the device so as to allow the device to be positioned within a labia of the user and to rebound outwardly to provide a reactionary force to engage in an interference fit with the labia such that the portion of the body that is disposed between the first and second side members and that is configured to vibrate in response to activation of the vibrator mechanism is in contact with the clitoris of the user.

2. The device of claim 1, further comprising a controller in communication with the vibrator mechanism.

3. The device of claim 2 in which the controller is enclosed within the body.

4. The device of claim 2, further comprising a transceiver electronically connected to the controller.

5. The device of claim 4 in which the transceiver is adapted to communicate wirelessly.

6. The device of claim 1 in which the device is configured to engage the labia outside a vaginal opening of the user.

7. The device of claim 1 in which the device comprises at least one vibration motor.

8. The device of claim 7 in which the at least one vibration motor is a pancake motor.

9. The device of claim 1 in which any of the first side member and second side member comprises a material that differs from a material of the body.

10. The device of claim 1 in which the body defines at least one open portion arranged to allow at least one of the first and second members to flex.

11. The device of claim 1 in which the body includes at least one raised portion configured to contact the clitoris when the first and second side members are engaged with the labia.

12. The device of claim 11 in which the at least one raised portion contains the vibrator mechanism.

13. The device of claim 1 in which the body includes at least one depressed portion configured to engage the labia outside a vaginal opening of the user.

14. The device of claim 1 in which the body has a concave curve corresponding to an anatomical curve.

15. The device of claim 1 in which at least one of the side members further comprises at least one adjustable element configured to engage the labia outside a vaginal opening of the user.

16. The device of claim 15 in which the at least one adjustable element is a spring.

17. A method of applying vibration to a clitoris of a user, the method comprising:

positioning a vibrator device on the user such that a first side member and a second side member of the vibrator device deflect inwardly due to a force compressing the first and second side members towards a center of the device so as to allow the device to be positioned within a labia of the user and to rebound outwardly to provide a reactionary force to engage in an interference fit with the labia and such that a portion of the vibrator device that is disposed between the first and second side members and that is configured to vibrate in response to activation of a vibrator mechanism is in contact with the clitoris and a vaginal opening of the user is unobstructed, wherein the first side member and the second side member extend from a body enclosing the vibrator mechanism in a manner such that at least the portion of the vibrator device that is configured to vibrate in response to activation of the vibrator mechanism is disposed between the first and second side members.

18. The method of claim 17 in which the vibrator device comprises at least one vibration motor.

19. The method of claim 18 in which the at least one vibration motor is a pancake motor.

20. The method of claim 17 in which the vibrator device further comprises a controller enclosed within the body and attached to the vibrator mechanism.

21. The method of claim 20 in which the vibrator device further comprises a transceiver electronically connected to the controller.

22. The method of claim 21 in which the transceiver is adapted to communicate wirelessly.

23. The method of claim 17 further comprising activating the vibrator device, wherein the vibrator device is configured to provide stimulation to the clitoris of the user.

24. The method of claim 23 further comprising penetrating the vaginal opening of the user with an object.

25. The method of claim 24, further comprising simultaneously providing stimulus to the clitoris and penetrating the vaginal opening of the user.

26. The method of claim 24 in which the object is a penis.

27. The method of claim 24 in which the object is a dildo.

* * * * *